US008857658B2

(12) United States Patent
Lin

(10) Patent No.: US 8,857,658 B2
(45) Date of Patent: Oct. 14, 2014

(54) PACKAGING CONTAINER

(71) Applicant: Rexam Plastic Packaging (HK) Co., Ltd., Hong Kong (CN)

(72) Inventor: Chinglang Lin, Hong Kong (CN)

(73) Assignee: Rexam Plastic Packaging (HK) Co., Ltd., North Point (HK)

( * ) Notice: Subject to any disclaimer, the term of this patent is extended or adjusted under 35 U.S.C. 154(b) by 0 days.

(21) Appl. No.: 13/740,202

(22) Filed: Jan. 13, 2013

(65) Prior Publication Data

US 2013/0181002 A1 Jul. 18, 2013

(30) Foreign Application Priority Data

Jan. 13, 2012 (CN) ..... 2012 1 0009706

(51) Int. Cl.
*B65D 43/16* (2006.01)

(52) U.S. Cl.
CPC ..... *B65D 43/164* (2013.01)
USPC ..... 220/827; 220/810; 16/232; 16/254; 16/255

(58) Field of Classification Search
CPC ..... B65D 43/16; B65D 43/162–43/164; A45D 40/22; A45D 40/221
USPC ..... 220/263, 264, 810, 827, 828, 829; 16/232, 254, 255, 257
See application file for complete search history.

(56) References Cited

U.S. PATENT DOCUMENTS

| | | | | | |
|---|---|---|---|---|---|
| 5,173,992 | A * | 12/1992 | Aihara et al. | ..... | 16/232 |
| 6,014,978 | A * | 1/2000 | Yuhara | ..... | 132/293 |
| 7,441,309 | B2 * | 10/2008 | Suzuki et al. | ..... | 16/330 |
| 2009/0165813 | A1 * | 7/2009 | Sekine | ..... | 132/293 |

FOREIGN PATENT DOCUMENTS

| | | | |
|---|---|---|---|
| CN | 201494698 | U | 6/2010 |
| CN | 201890435 | U | 7/2011 |
| CN | 202080500 | U | 12/2011 |

* cited by examiner

*Primary Examiner* — Fenn Mathew
*Assistant Examiner* — Madison L Poos
(74) *Attorney, Agent, or Firm* — Raymond Y. Chan; David and Raymond Patent Firm

(57) ABSTRACT

A packaging container includes a base, a cover including a resilient unit and defining a deformable slot at the resilient unit, and a positioning hinge member provided at the base and rotatably received at the deformable slot to pivotally couple the cover with the base so as to enable the cover being pivotally folded between an opened position and a closed position, wherein the positioning hinge member has a non-circular cross section and is arranged in such a manner that when the positioning hinge member is rotated within the deformable slot, the resilient unit generates a resilient restoring force to assist the cover being folded between the opened and closed positions.

14 Claims, 6 Drawing Sheets

PACKAGING CONTAINER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The prevent invention relates to a packaging container.

2. Description of Related Arts

China Patent CN201494698U disclosed, on Jul. 8, 2011, a lockable box comprising a box body, a base and a locker, wherein the locker comprises a locking ring, a locking member and a resilient hook. The locking ring is provided at one end of the locking member while the resilient hook is provided at another end of the locking member. The base is provided in the box body, wherein the base has a through hole formed at a sidewall of the base and communicated to an exterior of the box body through a sidewall of the box body. A raised platform is formed at a contact area between the base and the box body, wherein the raised platform has a diameter larger than a diameter of the through hole, such that the resilient hook is detachably inserted into the through hole to lock up the box body.

China Patent CN201890435U disclosed, on Jun. 2, 2010, a food packaging box comprising a bowl body, a bowl cover, and a sealing ring. A one-way valve, which is provided on the bowl body, comprises an air outlet, a spring, a silicon sealer, and an air duct. The air duct is engaged with the air outlet. The spring and the sealer are coupled at the air duct at a position that the spring is located on top of the sealer. The bowl cover is clipped on the bowl body via a pressurized clipper to seal the bowl body by the bowl cover.

China Patent CN202080500U disclosed, on Dec. 21, 2011, a pullable box comprising an exterior box body, an interior box body, and a sliding arrangement slidably coupled the interior box body with the exterior box body. The front end of the interior box body is coupled at a box cover of the exterior box body at a front end thereof. The pullable box further comprises a positioning unit provided between the sidewalls of the exterior and interior box bodies. The positioning unit comprises an elongated member provided at the sidewall of the interior box bodies, and a plurality of resilient members spacedly provided at the elongated member, and a blocking piece provided at the sidewall of the exterior box body. Accordingly, two ends of each of the resilient members are coupled at the elongated member to bend the resilient member at a curved configuration at the elongated member. When the interior box body is slidably coupled in the exterior box body, the blocking piece is selectively engaged with one of the resilient members to retain the relative position between the exterior and interior box bodies.

As shown in FIGS. 1 and 2, the packaging box, including the above three mentioned China Patents, generally comprises a base 11, a cover 12, and a metal or plastic made hinge 13 pivotally coupled the cover 12 with the base 11. The hinge 13 has a circular cross section. In particular, the cover 12 can be pivotally coupled with the base 11 between an opened position and a closed position. There are two mainly closing structures for the packaging box to retain the packaging box at the closed position.

FIG. 1 illustrates a first closing structure of the packaging box, wherein the hinge 13, having the circular cross section, is made of either metal or plastic to pivotally couple the cover 12 with the base 11. A first clipping member 111 and a second clipping member 121 are provided at the base 11 and the cover 12 respectively, wherein each of the first and second clipping members 111, 121 can be a fixed or movable clipper. When the cover 12 is pivotally folded to close the base 11, the first and second clipping members 111, 121 are engaged with each other to retain the packaging box at the closed position.

FIG. 2 illustrates a second closing structure of the packaging box, wherein a first engaging member 211 and a second engaging member 221 are provided at the base 21 and the cover 22 respectively, wherein each of the first and second engaging members 211, 221 can be a fixed or movable coupler. When the cover 22 is pivotally folded to close the base 21, the first and second engaging members 211, 221 are engaged with each other to retain the packaging box at the closed position.

SUMMARY OF THE PRESENT INVENTION

In order to overcome the above mentioned disadvantages, the present invention provides a packaging container, which does not require any external locking device to lock up packaging container at the closed position. Therefore, the invention is advantageous in that it provides a packaging container to keep the aesthetic appearance without adding any external locking device at the exterior of the packaging container.

According to the present invention, the foregoing and other objects and advantages are attained by a packaging container which comprises a base, a cover, a mirror, and a positioning hinge member. The positioning hinge member, which has a non-circular cross section, can be coupled at the base or directly mold-injected to the base to form an integrated structure. The cover is pivotally coupled with the base through the hinge members to pivotally fold between an opened position and a closed position. A folding portion of the cover is self-deformed with respect to the positioning hinge member to generate an opening/closing force to assist the opening/closing movement of the packaging box.

In particular, the cover comprises a resilient unit formed at the folding portion of the cover, wherein a deformable slot, which is an opening slot, is provided at the resilient unit to receive the positioning hinge member. The deformable slot has a corresponding cross section matching with the positioning hinge member and can be self-deformed by adjusting a width thereof. In addition, an upper clipping point and a lower clipping point are defined at an upper inner wall and a lower inner wall of the deformable slot respectively.

Furthermore, the positioning hinge member has a parallelogram and defines a preloaded corner, a cornering point and a positioning corner.

According to the present invention, the structure of the non-circular positioning hinge member of the packaging container is totally different from the structure of the conventional circular axle of the packaging box. The packaging container of the present invention does not require any locking device provided at either the base or the cover in order to lock up the packaging container at the closed position, so as to keep the aesthetic appearance of the packaging container. In addition, when the packaging box is folded between the opened and closed positions, a resilient restoring force is generated to assist the opening/closing movement of the packaging box without any spring installed into the packaging box, so as to substantially reduce the manufacturing cost of the packaging box. The packaging box of the present invention can be formed as a packaging box, packaging case for mobile phone, food packaging container, medication packaging container, which incorporates the positioning hinge member to pivotally couple the cover with the base.

Additional advantages and features of the invention will become apparent from the description which follows, and may be realized by means of the instrumentalities and combinations particular point out in the appended claims.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

FIG. 3 illustrates a packaging container according to a first preferred embodiment of the present invention, wherein FIG. 3*a* illustrates the packaging container at an opened position, wherein FIG. 3*b* illustrates a pivot structure of the packaging container via a non-circular positioning hinge member, wherein

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
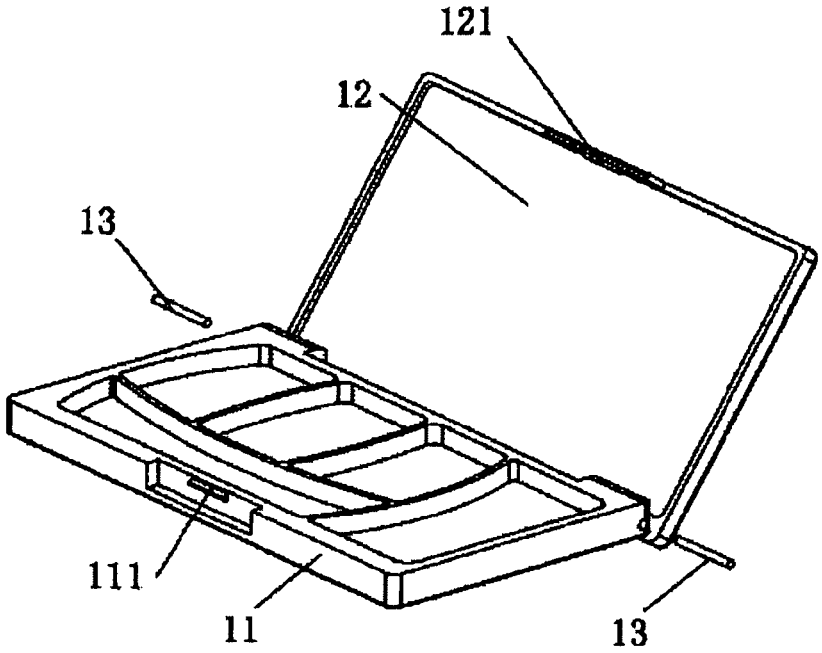
FIG.1 PRIOR ART
FIG. 1 illustrates a conventional packaging box with a first closing structure.
Figure 2:
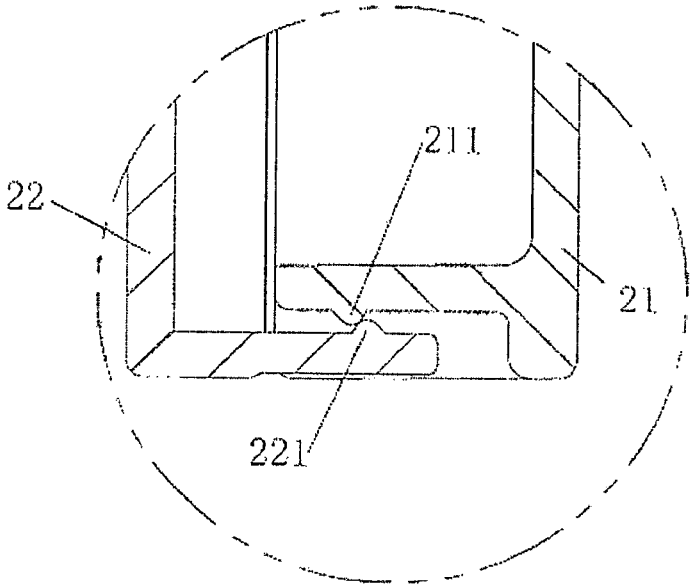
FIG.2 PRIOR ART
FIG. 2 illustrates a conventional packaging box with a second closing structure.
Figure 3A:
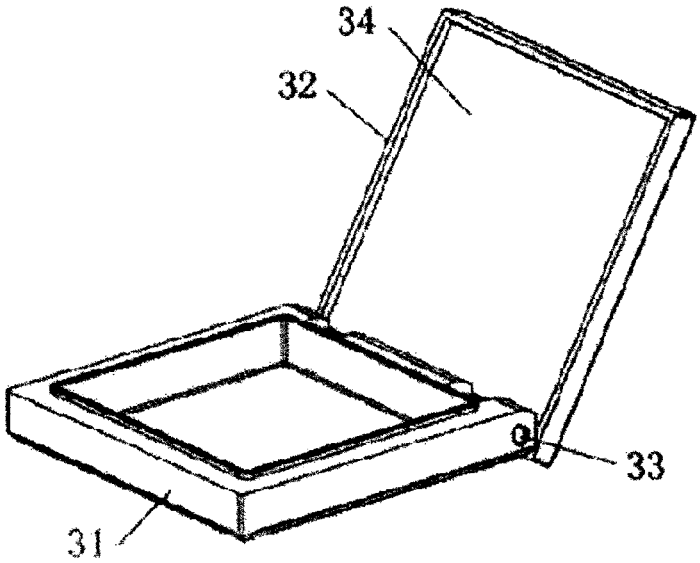
Figure 3B:
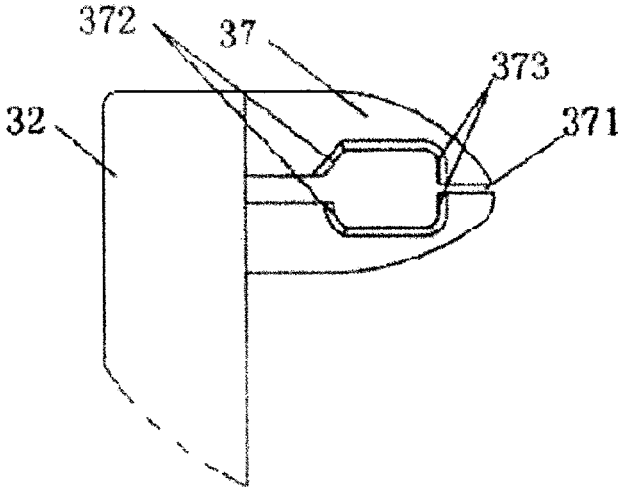
Figure 3C:
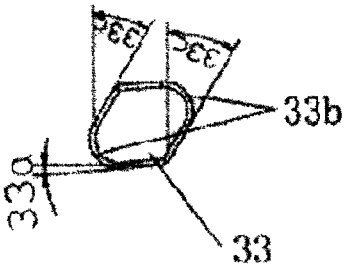
FIG. 3*c* illustrates the non-circular positioning hinge member of the packaging container.

Referring to FIG. 3 of the drawings, a packaging container according to a first embodiment of the present invention is illustrated, wherein the packaging container comprises a base 31, a cover 32, a mirror 34, and one or more positioning hinge members 33. The positioning hinge member 33, which has a non-circular cross section, can be coupled at the base 31 or directly mold-injected to the base 31 to form an integrated structure. The cover 32 is pivotally coupled with the base 31 through the hinge members 33 to pivotally fold between an opened position and a closed position. When the cover 32 is pivotally folded to close the base 31, a folding portion of the cover 32 is self-deformed with respect to the positioning hinge member 33 to generate a closing force to retain the packaging container at the closed position. Likewise, the folding portion of the cover 32 is self-deformed with respect to the positioning hinge member 33 to generate an opening force to retain the packaging container at the opened position.

The below description illustrates the operation of the packaging container of the present invention.

As shown in FIG. 3, during the opening operation of the cover 32, the cover 32 is pivotally folded from the base 31. When the cover 32 is pivotally folded at a predetermined opening angle, the folding portion of the cove 32 is self-deformed to generate the resilient opening force to push the cover 32 at the opening direction until the cover 32 is fully opened. During the closing operation of the cover 32, the cover 32 is pivotally folded toward the base 31. When the cover 32 is pivotally folded at a predetermined closing angle, the folding portion of the cove 32 is self-deformed to generate the resilient closing force to push the cover 32 at the closing direction until the cover 32 is fully closed.

According to the preferred embodiment, the cover 32 comprises a resilient unit 37 formed at the folding portion of the cover 32, wherein a deformable slot 371, which is an opening slot, is provided at the resilient unit 37 to receive the positioning hinge member 33. The deformable slot 371 has a corresponding cross section matching with the positioning hinge member 33 and can be self-deformed by adjusting a width thereof. In addition, an upper clipping point 372 and a lower clipping point 373 are defined at an upper inner wall and a lower inner wall of the deformable slot 371 respectively. When the cover 32 is pivotally folded between the opened and closed positions, the positioning hinge member 33 is rotated within the deformable slot 371. Since the positioning hinge member 33 is a non-circular axle, the upper and lower clipping points 372, 373 will limit the non-axially movement of the positioning hinge member 33 to prevent any offset between the cover 32 and the base 31 during the opening or closing operation of the cover 32.

According to the present invention, the positioning hinge member 33 has a parallelogram shape and defines a preloaded corner 33*a*, a cornering point 33*b* and a positioning corner 33*c*. The positioning hinge member 33 is rotated from the preloaded corner 33*a* to the positioning corner 33*c* through the cornering point 33*b* in order to pivotally fold the packaging container from the closed position to the opened position. When the packaging container is at the closed position that the cover 32 covers on the base 31, the positioning hinge member 33 is received in the deformable slot 371 at a position that the resilient unit 37 is deformed to generate the closing torque to retain the packaging container is at the closed position. The preloaded corner 33*a* of the position hinge member 33 will limit the opening movement of the cover 32. Accordingly, the closing torque will transform as the resilient closing force to ensure the packaging container at the closed position. During the opening operation, the cover 32 is pivotally folded with respect to the base 31 to rotate the positioning hinge member 33 within the deformable slot 371. At the same time, the width of the deformable slot 371 is gradually increasing during the rotation of the positioning hinge member 33. In other words, the resilient restoring force of the resilient unit 37 is gradually increasing as well. When the positioning hinge member 33 is rotated at a position that the coming point 33*b* of the positioning hinge member 33 biases against the inner wall of the deformable slot 371, the resilient restoring force of the resilient unit 37 will be maximized. It is worth mentioning that the cover 32 will tend to pivotally fold to its opened position when the coming point 33*b* of the positioning hinge member 33 biases against the inner wall of the deformable slot 371. Once the positioning hinge member 33 is further rotated to pass the coming point 33*b* thereof, the width of the deformable slot 371 is rapidly reduced. Therefore, the resilient restoring force of the resilient unit 37 will force the cover 32 to pivotally fold to the opened position at the positioning corner 33*c* of the positioning hinge member 33. In other words, the packaging container of the present invention does not require any external opening force manually to open the packaging container.

Figure 4:
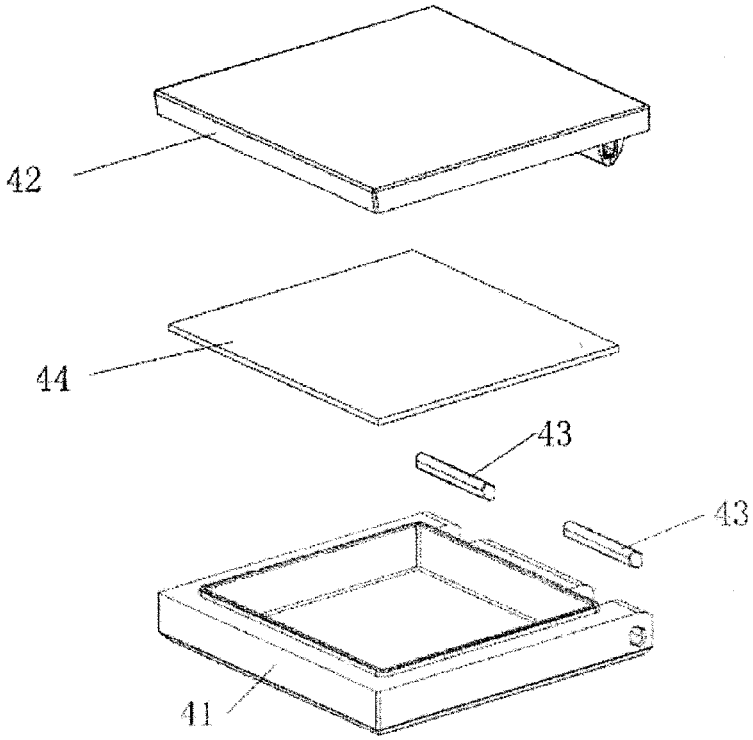
FIG. 4 is an exploded perspective view of a packaging container according to a second preferred embodiment of the present invention.

As shown in FIG. 4, a packaging container of a second embodiment illustrates an alternative mode of the first embodiment of the present invention. The packaging container comprises a base 41, a cover 42, and a positioning hinge member 43 provided at the base 41, wherein a mirror 44 is provided at the cover 42. The positioning hinge member 43, which has a non-circular cross section, can be coupled at the base 41 or directly mold-injected to the base 41 to form an integrated structure.

Figure 5:
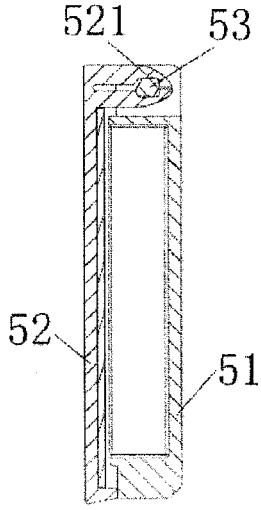
FIG. 5 is a sectional view of the packaging container according to the above second preferred embodiment of the present invention illustrating the packaging container at a closed position.

As shown in FIG. 5, a packaging container of a third embodiment illustrates an alternative mode of the first embodiment of the present invention. The packaging container comprises a base 51, a cover 52, and a positioning hinge member 53 provided at the base 51. The positioning hinge member 53, which has a non-circular cross section, can be coupled at the base 51 or directly mold-injected to the base 51 to form an integrated structure. The cover 52 further has a resilient unit 521 provided at the folding portion to engage with the positioning hinge member 53.

Figure 6:
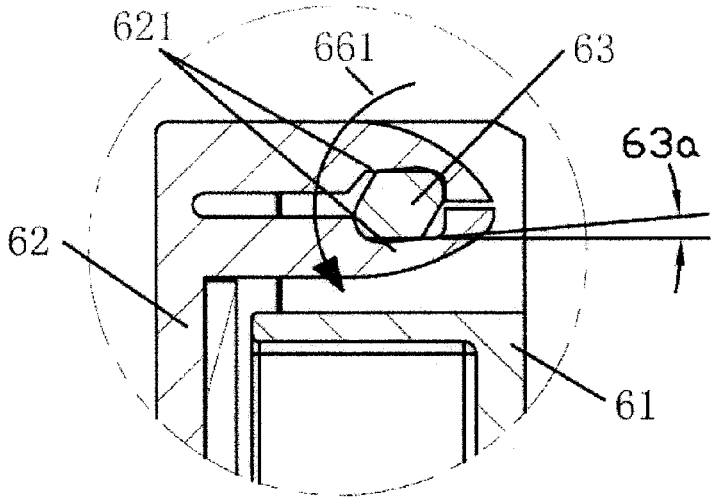
FIG. 6 is a partially enlarged view of the hinge member of the packaging container according to the above second preferred embodiment of the present invention.

As shown in FIG. 6, a packaging container comprises a base 61, a cover 62, and a positioning hinge member 63 provided at the base 61. The positioning hinge member 63, which has a non-circular cross section, defines a preloaded corner 63*a*. The cover 62 further has a resilient unit 621 provided at the folding portion to engage with the positioning hinge member 63. The preloaded corner 63*a* of the position hinge member 63 will limit the opening movement of the cover 62 and will generate the closing torque 661 to ensure the packaging container at the closed position.

Figure 7:
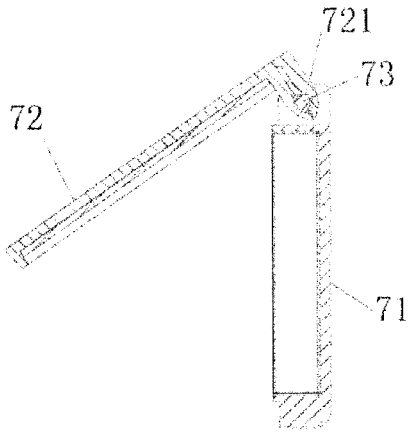
FIG. 7 illustrates the self-deformed cover of the packaging container according to the above second preferred embodiment of the present invention.

As shown in FIG. 7, a packaging container of a fourth embodiment illustrates an alternative mode of the first embodiment of the present invention. The packaging container comprises a base 71, a cover 72, and a positioning hinge member 73 provided at the base 71. The positioning hinge member 73, which has a non-circular cross section, can be coupled at the base 71 or directly mold-injected to the base 71 to form an integrated structure. The cover 72 further has a resilient unit 721 provided at the folding portion to engage with the positioning hinge member 73.

Figure 8:
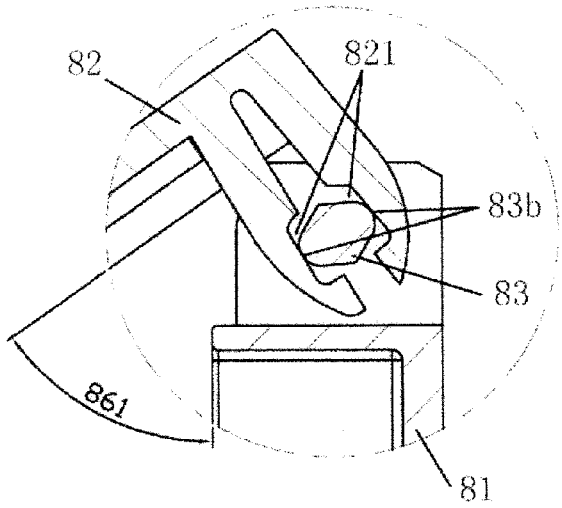
FIG. 8 is a partially enlarged view of the hinge member of the packaging container according to the above second preferred embodiment of the present invention, illustrating the relationship between the cover and the positioning hinge member.

As shown in FIG. 8, a packaging container comprises a base 81, a cover 82, and a positioning hinge member 83 provided at the base 81. The positioning hinge member 83, which has a non-circular cross section, defines a cornering point 83*b*. The cover 82 further has a resilient unit 821 provided at the folding portion to engage with the positioning hinge member 83. When the positioning hinge member 83 is rotated at the cornering point 83*b* to maximize the resilient restoring force of the resilient unit 821, the cover 82 is pivotally folded with respect to the base 81 at a threshold angle 861. When a folding angle between the base 81 and the cover 82, i.e. the folding operation of the packaging container between the opened and closed positions, is smaller than the threshold angle 861, the resilient unit 821 will generate the resilient restoring force to push the cover 82 toward the base 82 so as to close the packaging container. When the folding angle between the base 81 and the cover 82 is larger than the threshold angle 861, the resilient unit 821 will generate the resilient restoring force to push the cover 82 away the base 82 so as to open the packaging container.

Figure 9:
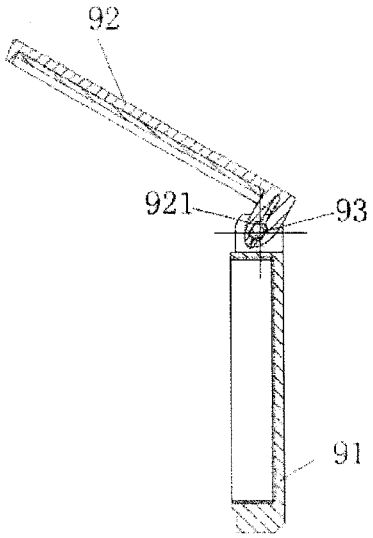
FIG. 9 is a sectional view of the packaging container according to the above second preferred embodiment of the present invention illustrating the packaging container at an opened position.

As shown in FIG. 9, a packaging container of a fifth embodiment illustrates an alternative mode of the first embodiment of the present invention. The packaging container comprises a base 91, a cover 92, and a positioning hinge member 93 provided at the base 91. The positioning hinge member 93, which has a non-circular cross section, can be coupled at the base 91 or directly mold-injected to the base 91 to form an integrated structure. The cover 92 further has a resilient unit 921 provided at the folding portion to engage with the positioning hinge member 93.

Figure 10:
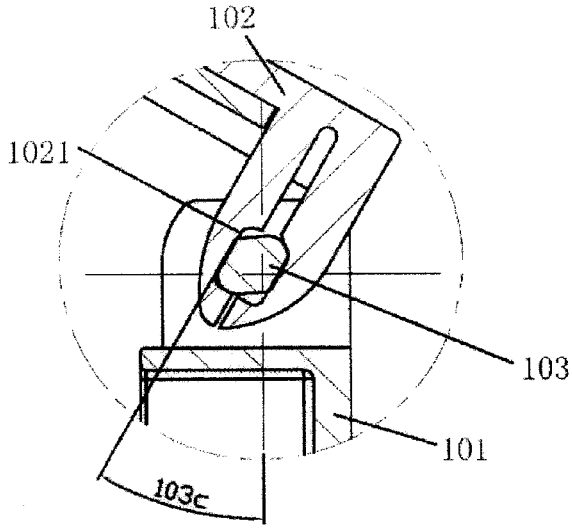
FIG. 10 is a partially enlarged view of the hinge member of the packaging container according to the above second preferred embodiment of the present invention, illustrating the relationship between the cover and the positioning hinge member at an opened position.

As shown in FIG. 10, a packaging container comprises a base 101, a cover 102, and a positioning hinge member 103 provided at the base 101. The positioning hinge member 103, which has a non-circular cross section, defines a positioning corner 103*c*. The cover 102 further has a resilient unit 1021 provided at the folding portion to engage with the positioning hinge member 103. When the positioning hinge member 103 is rotated at the positioning corner 103*c*, the resilient restoring force of the resilient unit 821 is minimized. Therefore, the cover 102 can be stably retained at the opened position.

Figure 11:
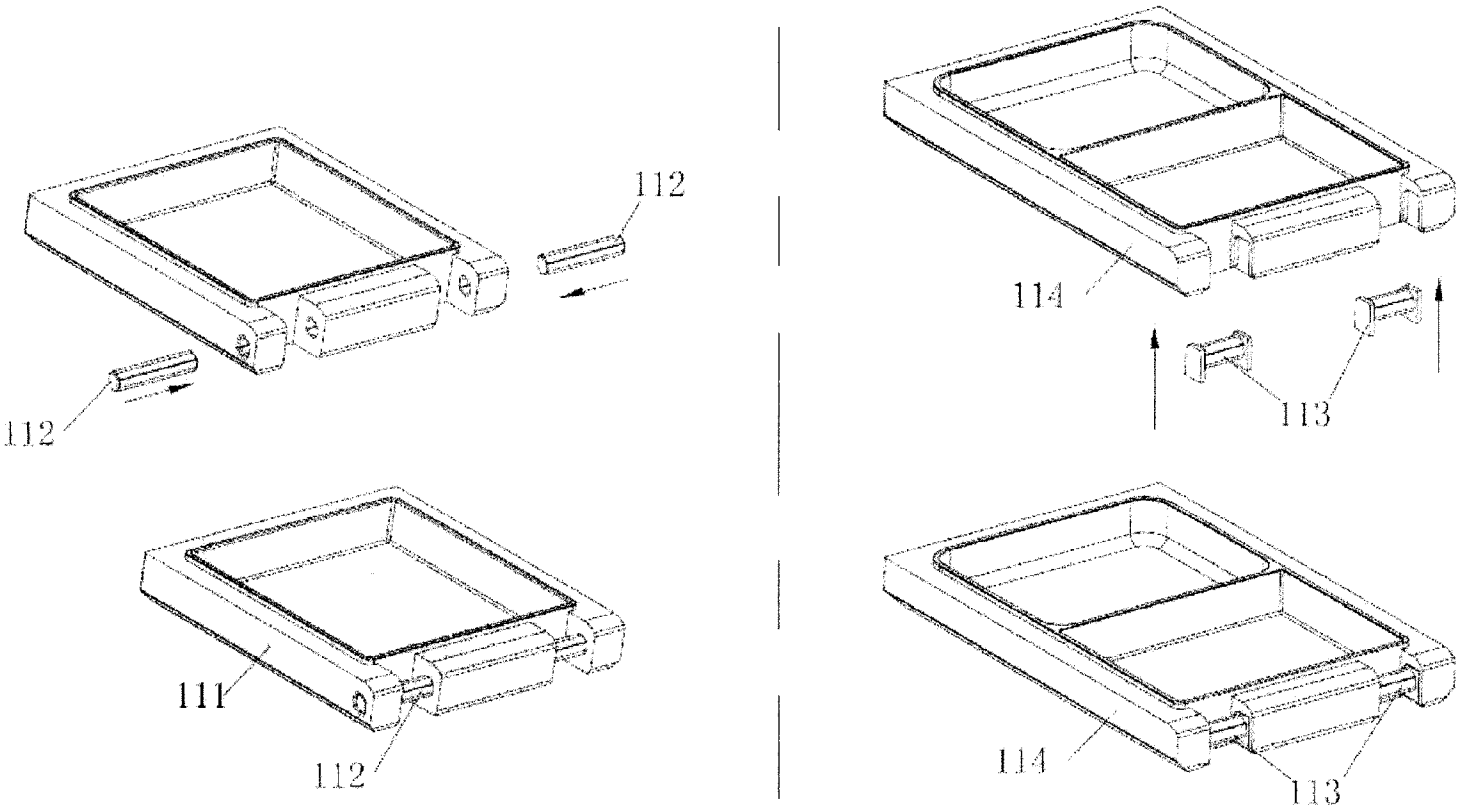
FIG. 11 illustrates a first installation method of the positioning hinge member of the packaging container according to the above first and second preferred embodiments of the present invention.

FIG. 11 illustrates the first installation structure of the packaging container which comprises a base 111 and a positioning hinge member 112 slidably inserted to the base 11 from a sidewall thereof. Alternatively, a positioning hinge member 113 can be slidably coupled at a base 114 from a bottom thereof.

Figure 12:
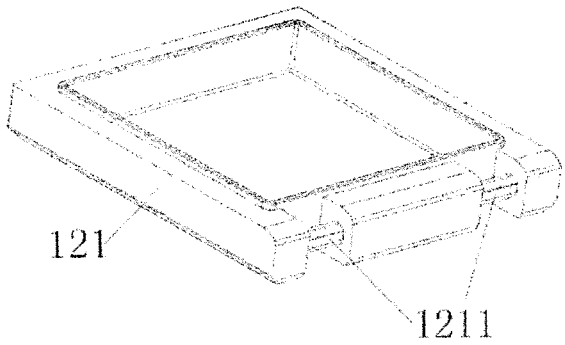
FIG. 12 illustrates a second installation method of the positioning hinge member of the packaging container according to the above first and second preferred embodiments of the present invention.

FIG. 12 illustrates the second installation structure of the packaging container, wherein a positioning hinge member 1211 is mold-injected to a base 121 to form an integrated structure.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A packaging container, comprising:

a base;

a cover comprising a resilient unit and defining a deformable slot at said resilient unit; and a positioning hinge member provided at said base and rotatably received at said deformable slot to pivotally couple said cover with said base so as to enable said cover being pivotally folded between an opened position and a closed position, wherein said positioning hinge member has a non-circular cross section and is arranged in such a manner that when said positioning hinge member is rotated within said deformable slot, said resilient unit generates a resilient restoring force to assist said cover being folded between said opened and closed positions, wherein said positioning hinge member has a preloaded corner, a cornering point and a positioning corner that said positioning hinge member is rotated from said preloaded corner to said positioning corner through said cornering point in order to pivotally fold said cover from said closed position to said opened position.

2. The packaging container, as recited in claim 1, wherein a threshold angle is defined between said base and said cover when said positioning hinge member is rotated at said cornering point, wherein when a folding angle between said base and said cover is smaller than said threshold angle, said resilient unit generates as resilient restoring force as a closing force to push said cover toward said base so as to close said packaging container, wherein when said folding angle between said base and said cover is larger than said threshold angle, said resilient unit generates as resilient restoring force as an opening force to push said cover away said base so as to open said packaging container.

3. The packaging container, as recited in claim 1, wherein said positioning hinge member has a parallelogram shape.

4. The packaging container, as recited in claim 2, wherein said positioning hinge member has a parallelogram shape.

5. The packaging container, as recited in claim 2, wherein said deformable slot has a cross section matching with said cross section of said positioning member.

6. The packaging container, as recited in claim 4, wherein said deformable slot has a cross section matching with said cross section of said positioning member.

7. The packaging container, as recited in claim 4, wherein said deformable slot is an open slot adapted to self-deform to adjust a width thereof.

8. The packaging container, as recited in claim 6, wherein said deformable slot is an open slot adapted to self-deform to adjust a width thereof.

9. The packaging container, as recited in claim 6, wherein said cover has an upper clipping point and a lower clipping point defined at an upper inner wall and a lower inner wall of said deformable slot respectively for limiting a non-axially movement of said positioning hinge member.

10. The packaging container, as recited in claim 8, wherein said cover has an upper clipping point and a lower clipping point defined at an upper inner wall and a lower inner wall of said deformable slot respectively for limiting a non-axially movement of said positioning hinge member.

11. The packaging container, as recited in claim 10, wherein said positioning hinge member is slidably inserted to said base from a sidewall thereof.

12. The packaging container, as recited in claim 10, wherein said positioning hinge member is slidably coupled to said base from a bottom thereof.

13. The packaging container, as recited in claim 10, wherein said positioning hinge member is mold-injected to said base to form an integrated structure.

14. A packaging container, comprising:

a base;

a cover comprising a resilient unit and defining a deformable slot at said resilient unit; and a positioning hinge member provided at said base and rotatably received at said deformable slot to pivotally couple said cover with said base so as to enable said cover being pivotally folded between an opened position and a closed position, wherein said positioning hinge member has a non-circular cross section and is arranged in such a manner that when said positioning hinge member is rotated within said deformable slot, said resilient unit generates a resilient restoring force to assist said cover being folded between said opened and closed positions, wherein said positioning hinge member is slidably coupled at said base.

* * * * *